US010511912B2

(12) United States Patent
Kirisken

(10) Patent No.: US 10,511,912 B2
(45) Date of Patent: Dec. 17, 2019

(54) SOUND REPRODUCING DISPLAY

(71) Applicant: Vestel Elektronik Sanayi ve Ticaret A. S., Manisa (TR)

(72) Inventor: Barbaros Kirisken, Manisa (TR)

(73) Assignee: VESTEL ELEKTRONIK SANAYI VE TICARET A.S., Manisa (TR)

( * ) Notice: Subject to any disclaimer, the term of this patent is extended or adjusted under 35 U.S.C. 154(b) by 0 days.

(21) Appl. No.: 15/754,183

(22) PCT Filed: Sep. 14, 2016

(86) PCT No.: PCT/EP2016/071690
§ 371 (c)(1),
(2) Date: Feb. 21, 2018

(87) PCT Pub. No.: WO2017/046161
PCT Pub. Date: Mar. 23, 2017

(65) Prior Publication Data

US 2018/0249251 A1 Aug. 30, 2018

(30) Foreign Application Priority Data

Sep. 14, 2015 (EP) ..... 15184991

(51) Int. Cl.
*H04R 7/04* (2006.01)

(52) U.S. Cl.
CPC ..... *H04R 7/04* (2013.01); *H04R 7/045* (2013.01); *H04R 2440/05* (2013.01); *H04R 2499/11* (2013.01); *H04R 2499/15* (2013.01)

(58) Field of Classification Search
CPC ..... H04R 7/04; H04R 7/045; H04R 2499/11; H04R 2499/15; H04M 1/0249; H04M 1/026; H04M 1/0266; H04M 2201/38
(Continued)

(56) References Cited

U.S. PATENT DOCUMENTS 5,828,768 A * 10/1998 Eatwell ..... G06F 1/1616 381/333
2014/0241558 A1* 8/2014 Yliaho ..... H04R 5/02 381/333
2015/0086063 A1* 3/2015 Louh ..... H04R 1/028 381/388

FOREIGN PATENT DOCUMENTS

CN 1194767 A2 9/1998
EP 0 847 677 4/1999
(Continued)

OTHER PUBLICATIONS

Corteel et al. "Multichannel Inverse Filtering of Multiexciter Distributed Mode Loudspeakers for Wave Field Synthesis", May 2002, Audio Engineering Society, Convention Paper 5611, All pages. (Year: 2002).*

(Continued)

*Primary Examiner* — Jesse A Elbin
(74) *Attorney, Agent, or Firm* — McDonnell Boehnen Hulbert & Berghoff LLP

(57) ABSTRACT

The present invention provides a display device (1; 101) comprising an imaging plane (2; 103) configured to controllably display an image, a backplane (3) located behind the imaging plane (2; 103), a number of sound actuators (4; 104, 105) configured to produce vibrations based on a driving signal (5), and at least one mechanical coupling element (6) for every sound actuator (4; 104, 105) configured to mechanically couple the imaging plane (2; 103) through the backplane (3) with the sound actuators (4; 104, 105).

10 Claims, 8 Drawing Sheets

(58) Field of Classification Search
USPC ..... 381/152, 306, 333, 388; 455/3.06
See application file for complete search history.

(56) References Cited

FOREIGN PATENT DOCUMENTS

| | | |
|---|---|---|
| EP | 1 100 288 | 5/2001 |
| WO | WO 01/74114 A2 | 10/2001 |

OTHER PUBLICATIONS

The International Search Report (ISR) for PCT/EP2016/071690 dated Nov. 8, 2016, pp. 1-10.

* cited by examiner

SOUND REPRODUCING DISPLAY

CROSS-REFERENCE TO RELATED APPLICATION

This application is a U.S. national phase of International Application No. PCT/EP2016/071690, filed on Sep. 14, 2016, which claims priority to European Patent Application No. 15184991.6, filed Sep. 14, 2015, both of which are incorporated by reference herein in their entirety.

TECHNICAL FIELD

The invention relates to a display device and to a method for reproducing sound with a display device.

BACKGROUND

Although applicable to any system that reproduces sound, the present invention will be described in combination with display devices with integrated sound generation means.

In modern display applications it is not only necessary to display visual content via a display. It is frequently further required to reproduce together with visual data corresponding audio data, e.g. to play a video. Therefore, known display devices are usually equipped with separate internal or external speakers to reproduce audio content. Incorporating speakers in e.g. a mobile phone or a television requires additional space in the housing of the respective device and the speakers must be positioned adequately to reproduce the sound with acceptable quality.

Therefore, displays have been developed where the whole display, i.e. the front surface of the respective device, is vibrated by a vibration device to generate sound waves.

Such transducers are needed to mechanically touch a front surface of the respective display. This can be achieved by an additional opaque panel which surrounds the display and is vibrated by a respective transducer, which is placed beside the display unit. But this option increases the bezel size which is an unwanted effect.

Alternatively an additional transparent panel can be used in front of the display. But this decreases overall luminance of the display.

It is further known from document US 2014/0 241 558 to vibrate the whole screen including front glass, cell and BLU assembly. Further, in WO 2001/074114 segmented LCD displays are separately vibrated.

Document EP 1 100 288 A2 discloses an acoustic radiator, which includes a plate-like member, which has elastic properties in a driving frequency band for acoustic radiation. Document EP 0 847 677 A1 discloses an inertial vibration transducer characterised by a plate-like piezo-electric bender and means adapted to mount the bender on a member to be vibrated. Document US 2015/0 086 063 A1 discloses a speaker, which includes a hollow glass substrate and a plurality of vibration exciters, where the vibration exciters are attached to the glass substrate to drive the glass substrate to vibrate.

Accordingly, there is a need for an improved method of reproducing sound with a display device.

SUMMARY

The present invention provides a display device with the features of claim 1 and a method with the features of claim 6.

Therefore, a display device is provided comprising an imaging plane configured to controllably display an image, a backplane located behind the imaging plane, i.e. behind when viewing the display device from the front, a number, i.e. one or more, of sound actuators configured to produce vibrations based on a driving signal, and at least one mechanical coupling element for every sound actuator configured to mechanically couple the imaging plane through the backplane with the sound actuators.

Furthermore, a method for reproducing sound with a display device is provided, the method comprising the steps of producing vibrations based on a driving signal with a number, i.e. one or more, of sound actuators in a display device, transferring the vibrations mechanically with at least one mechanical coupling element for every sound actuator to an imaging plane of the display device through a backplane of the display device.

The display device according to the present invention can be any type of active display, e.g. a display for handheld or mobile devices or smartwatches, a computer display, a television display or the like.

The present invention provides a display device where the active imaging plane, i.e. a LCD cell or plane, an OLED plane comprising active organic LEDs, or the like, is directly contacted mechanically and vibrated by the sound actuators, also called transducers or exciters. The sound actuators or exciters can comprise electromagnetic, piezoelectric, magnetostrictive transducers, moving coil motors or the like. In principle any technology can be used that can be constructed small enough to fit into a housing of the display device behind the backplane.

The backplane can in case of an LCD based imaging plane e.g. be backlight unit of the display device. Such a backlight unit or BLU can e.g. be an edge-lit BLU using LEDs as edge positioned light sources. This means that LEDs are positioned at the edge of the display device and the light is uniformly distributed behind the LCD cell or panel to illuminate the image shown by the LCD cell. The backplane can in addition to the edge LEDs comprise different light diffusor layers, prism layers, and/or light guide plates or the like to provide a uniform distribution of the light from the edge positioned LEDs over the complete surface of the backplane. Alternatively a full array LED backplane can be provided in the BLU, where LEDs are uniformly distributed over the surface of the backplane. Furthermore, cold cathode fluorescent backlights or the like can be used. Depending on the technology used for the active imaging plane, respective other backplanes can be provided.

If the sound actuators would be positioned between the active imaging plane and the backplane the sound actuators would obstruct the backplane and would be visible as dark spots in the imaging plane, because the light could not travel from the backplane to the imaging plane. Therefore, the sound actuators are positioned behind the backplane. In order to actuate the imaging plane and induce vibrations in the imaging plane the sound actuators are configured to mechanically couple to the imaging plane and transmit vibrations to the imaging plane via this mechanical coupling. This means that the sound actuators are positioned behind the backplane and therefore can't obstruct the backplane and the light emanating from the backplane.

Summing up, the display device according to the present invention or more specifically the imaging plane is used as a kind of bending wave loudspeaker or acoustic radiator plane and renders moot the use of separate loudspeakers in the display device. At the same time the sound actuators can be very flexibly placed behind the backplane without requiring additional bezels or other disturbing layers over the imaging plane.

Therefore, the display device according to the present invention is especially useful in applications with strict space restrictions like mobile applications, e.g. smartphones, tablet computers, smart watches or the like. Nevertheless the display device according to the present invention can also be used in any other application where images and sounds have to be reproduced. Such applications can e.g. be televisions, laptop computers, navigation system screens or the like.

Further embodiments of the present invention are subject of the further subclaims and of the following description, referring to the drawings.

In a possible embodiment the mechanical coupling elements can each comprise a number of support rods, which on one end couple to the respective sound actuator and on the other end couple to the imaging plane. Such support rods or pillars provide a direct mechanical coupling between the sound actuator and the imaging plane and therefore provide a simple and effective way of transferring vibrations from the sound actuator to the imaging plane.

In another possible embodiment the backplane can comprise holes for the support rods which have an inner contour which is spaced apart by a predetermined distance from the outer contour of the support rods. This means that all layers, plates or sub-planes of the backplane comprise the holes at the same position. The holes traverse the whole of the backplane. The contour of the holes can e.g. be circle shaped. In such an embodiment the diameter of the holes is bigger than the diameter of the support rods. With support rods with a square shaped cross section the width of the holes would be greater than the width of the support rods. Such holes in the backplane allow the rods to move freely and effectively transfer the vibrations to the imaging plane in front of the backplane.

In a possible embodiment the backplane can comprise a light guide plate, wherein the support rods comprise a material configured to at least partially guide light. Such a material selection allows light to couple from the light guide plate into the support rods which than guide the light to the imaging plane. This will allow illuminating the pixels of the imaging plane which lay directly in front of the support rods. Therefore, the display device will provide a homogenously illuminated image.

In a further possible embodiment the display device can comprise light coupling elements in the light guide plate especially at the edges of the holes, the light coupling elements being configured to couple light from the light guide plate into the support rods. Providing dedicated light coupling elements, like e.g. specially formed transparent plastic elements like prisms, provides a high transmission rate from the light guide plate to the support rods, i.e. the intensity of the light provided to the imaging plane via the support rods is almost the same as the intensity of the light provided to the imaging plane directly via the light guide plate.

In a possible embodiment the cross section of the support rods can be smaller than three pixels, especially less than two pixels or less than one pixel of the imaging plane. The smaller the support rods are the fewer disturbances in the homogeneity of the light distribution will be visible on the imaging plane.

In another possible embodiment the display device can comprise two sound actuators being placed in a front view of the display device on opposite sides and different heights of the display device behind the imaging plane of the display device. One sound actuator can e.g. be placed on the lower left side while the other sound actuator can be placed on the upper right side. This places the sound actuators in the display device with the maximum possible distance. Therefore, vibrations induced by the sound actuators into the imaging plane interfere with each other as little as possible.

In one embodiment the display device comprises a plurality of sound actuators, which are configured to collectively perform a wave field synthesis of sounds. The single sound actuators and the respective section of the imaging plane therefore together form an array of loudspeakers.

In one embodiment the display device comprises a plurality of mechanically decoupled display sections which each comprise an imaging plane, a backplane and a sound actuator. Such decoupled display sections can in one embodiment also be used to perform wave field synthesis of sounds.

BRIEF DESCRIPTION OF THE DRAWINGS

For a more complete understanding of the present invention and advantages thereof, reference is now made to the following description taken in conjunction with the accompanying drawings. The invention is explained in more detail below using exemplary embodiments which are specified in the schematic figures of the drawings, in which.

In the figures like reference signs denote like elements unless stated otherwise.

DETAILED DESCRIPTION OF THE DRAWINGS

Figure 1:
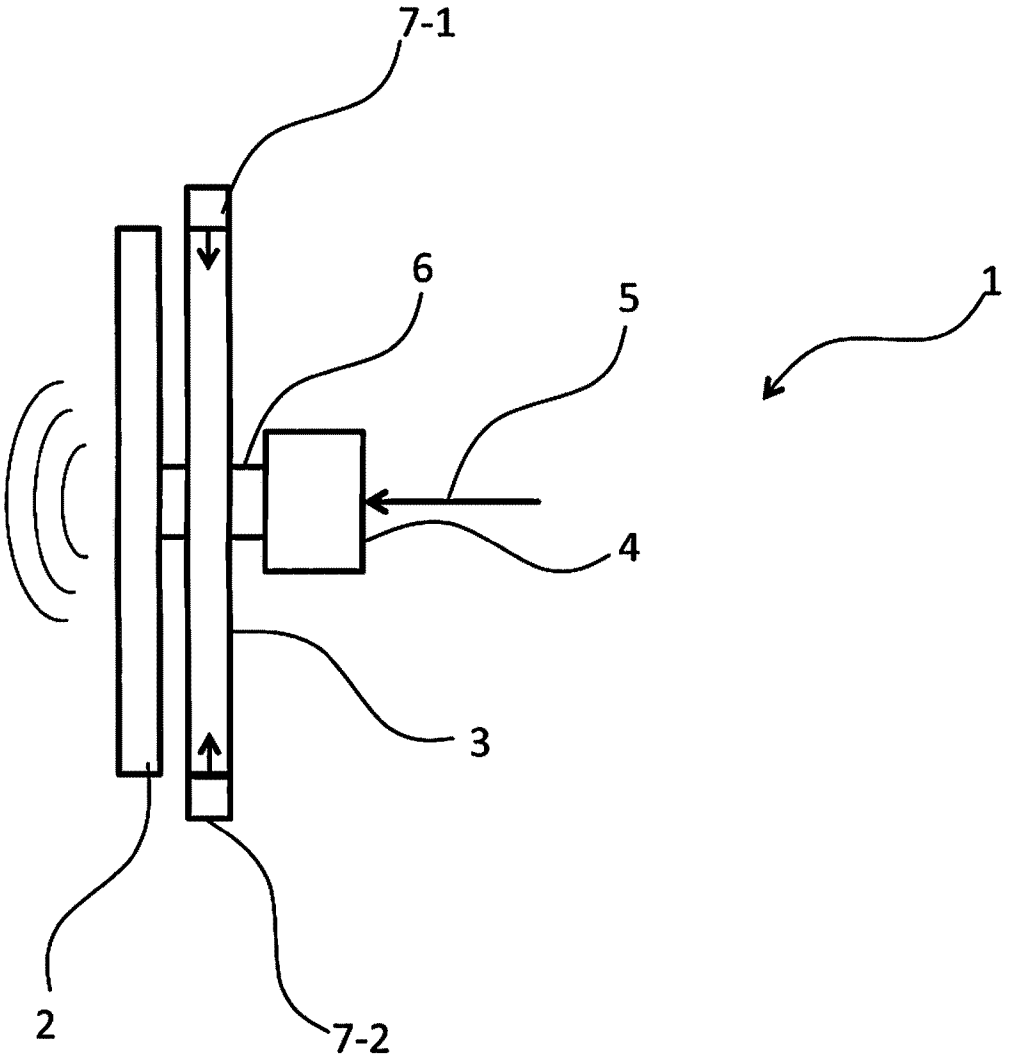
FIG. 1 shows a schematic diagram of a smartphone or tablet display according to the present invention.

FIG. 1 shows a schematic diagram of an embodiment of a display device 1 according to the present invention.

The display device 1 is a smartphone or tablet display 1 and comprises a LCD cell as imaging plane 2. In the case of the LCD cell 2 a separate lighting is necessary to illuminate the display device 1 or the image displayed by the display device 1 because LCD cells 2 can't actively emit light.

Therefore, the display device 1 comprises a backplane 3 which comprises edge mounted LEDs 7-1, 7-2. Only LEDs 7-1 and 7-2 are shown in FIG. 1 but any adequate number of LEDs can be used to illuminate the display device 1. In the case of edge mounted LEDs 7-1, 7-2 light is emitted by the LEDs into the backplane 3, where it is distributed as uniformly as possible to illuminate the imaging plane 2 and provide a homogenous image with the display device 1. The imaging plane 2 and the backplane 3 in principle suffice to display images with the display device 1.

The present invention in addition to displaying images with the display device 1 also provides means to reproduce audible sounds with the display device 1 without requiring dedicated loud speakers. In FIG. 1 therefore a sound actuator 4 is positioned behind the backplane 3. The sound actuator 4 generates vibrations based on a driving signal 5, which can e.g. be generated by a (not shown) audio amplifier 502 (see FIG. 7). To actually generate audible sound waves the sound actuator 4 is mechanically connected to the imaging plane 2 via a coupling element 6, which traverses the backplane 3 and transports the vibrations from the sound actuator 4 to the imaging plane 2.

Therefore, if the sound actuator 4 or an active element of the sound actuator 4 is made to vibrate, this vibration is transferred to the front of the display device 1, i.e. the imaging plane 2 is made to vibrate accordingly. If the imaging plane 2 vibrates it radiates sound waves which travel through the air in front of the display device 1 and can be perceived as audible sounds e.g. by a user in the vicinity of the display device 1.

Control units for controlling the imaging plane 2, the backplane 3, i.e. the LEDs 7-1, 7-2, and the sound actuator 4, and further electric circuitry needed to drive these elements are not shown for ease of understanding. But it is to be understood that any number of such control units and other circuitry can be incorporated in a display device 1 as needed.

Figure 2:
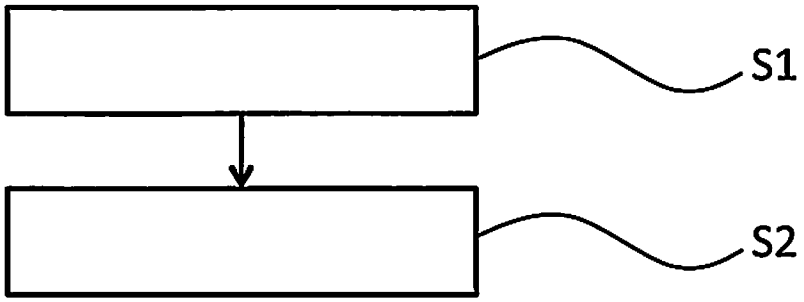
FIG. 2 shows a flow diagram of an embodiment of a method for reproducing sound with a display device according to the present invention.

FIG. 2 shows a flow diagram of an embodiment of a method according to the present invention for reproducing sound with a display device 1, 101.

In a first step S1 vibrations are produced based on a driving signal 5 with a number of sound actuators 4, 104, 105 in a display device 1, 101. These vibrations are mechanically transferred in step S2 with at least one mechanical coupling element 6 for every sound actuator 4, 104, 105 to an imaging plane 2, 103 of the display device through a backplane 3 of the display device 1.

The step S2 of transferring the vibrations mechanically can comprise transferring the vibrations with support rods 306-1 to 306-3, which on one end couple to the respective sound actuator 4, 104, 105 and on the other end couple to the imaging plane 2, 103. For the support rods 306-1 to 306-3 to move freely holes 8-1 to 8-3 can be provided in the backplane 3 which have an inner contour which is spaced apart by a predetermined distance from the outer contour of the support rods 306-1 to 306-3. That means during movement the support rods 306-1 to 306-3 don't touch the backplane 3.

To illuminate an image which is displayed by the display device 1 light can be guided in the backplane 3, e.g. with a light guide plate 304. To provide a homogenous image light can also be guided at least partially from the light guide plate 304 through the support rods 306-1 to 306-3 to the front of the imaging plane 2. To improve the light transmission the light can be coupled into the support rods 306-1 to 306-3 using light coupling elements 6, e.g. prisms or the like in the light guide plate 304.

Figure 3:
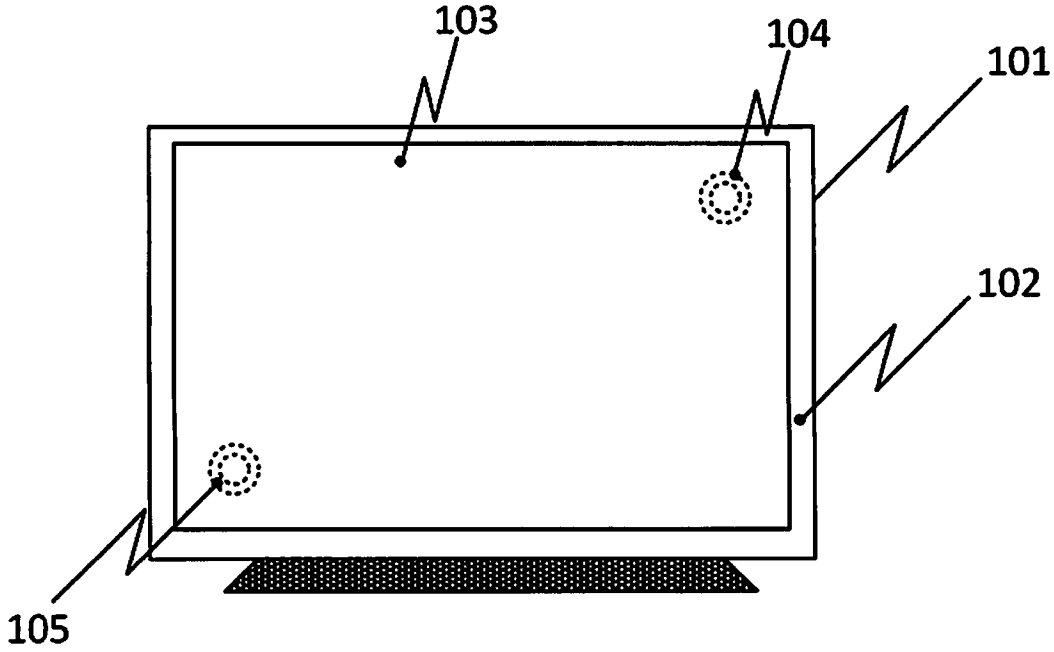
FIG. 3 shows a diagram of a television according to the present invention.

FIG. 3 shows a further diagram of an embodiment of a display device 101 according to the present invention. The display device in FIG. 3 is embodied as a LCD television 101.

The television 101 comprises a front bezel 102, which surrounds the LCD cell 103, aka the imaging plane. Furthermore, two sound actuators 104, 105 are shown in FIG. 3 as dotted circles. The dotted circles indicate that the sound actuators 104, 105 are positioned inside a housing of the television 101 but behind the LCD cell 103 and a not visible backplane of the television 101.

The configuration of FIG. 3 allows reproducing stereo sounds with the LCD cell 103. Viewed from the front of the television 101 sound actuator 104 is positioned behind the upper right corner of the LCD cell 103. The sound actuator 105 is positioned behind the lower left corner of the LCD cell 103. The positions of the sound actuators 104, 105 provide the maximum possible distance between the sound actuators 104, 105. Therefore, the vibrations of the sound actuators 104, 105 interfere with each other as little as possible. It is to be understood that a vibration margin is to be provided between the sound actuators 104, 105 and the bezel 102 which allows the sound actuators 104, 105 or the respective section of the LCD cell 103 to vibrate freely. Therefore the sound actuators 104, 105 are not placed at the edge of the LCD cell 103 but spaced apart from the bezel 102 by said vibration margin.

Figure 4:
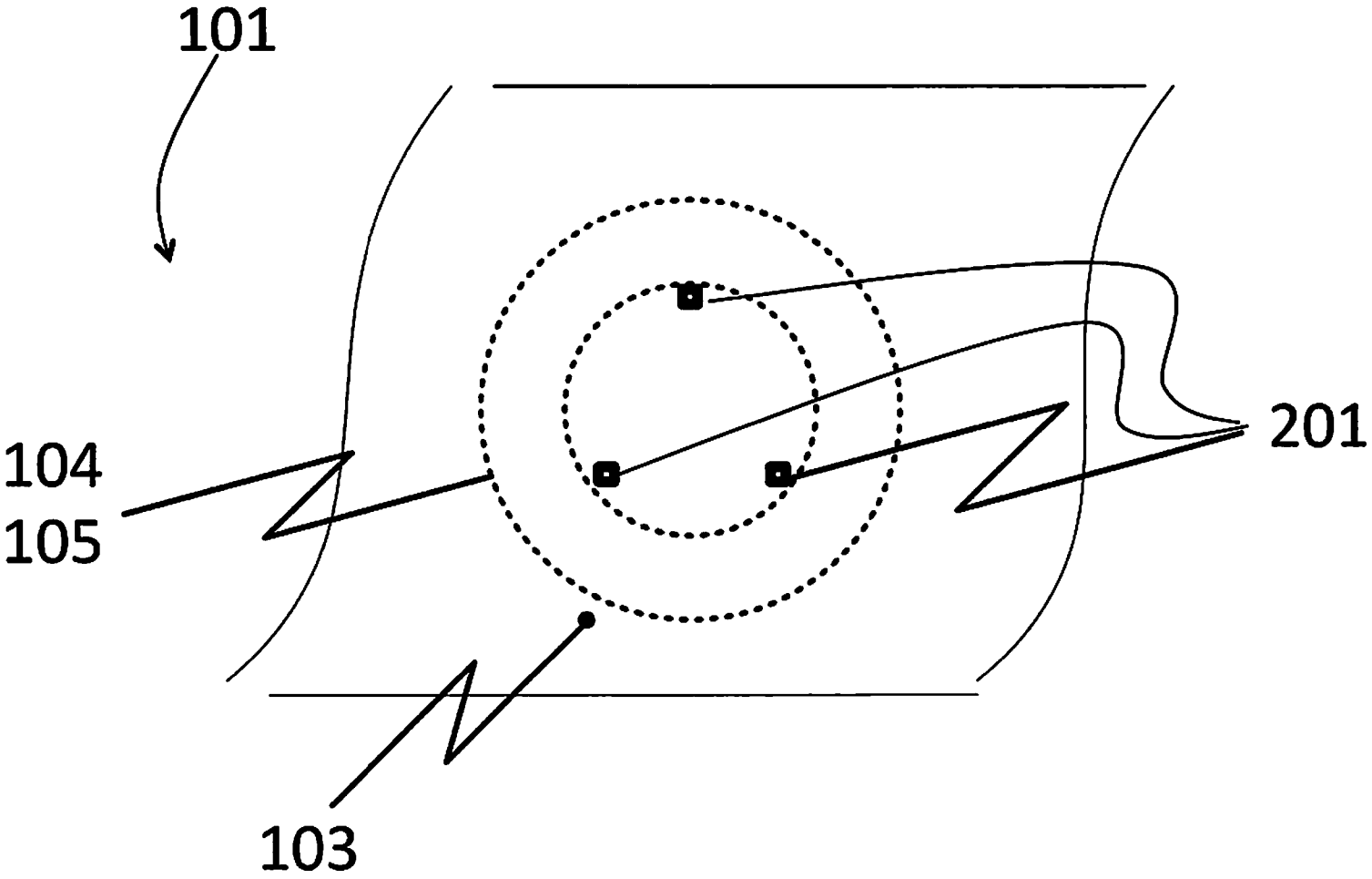
FIG. 4 shows a further diagram of the television according to the present invention.

FIG. 4 shows a partial diagram of the display device 101, especially the section of the LCD cell 103 with the sound actuators 104, 105. Because the configuration of the LCD cell 103 with the sound actuators 104, 105 is identical in both cases only one diagram is shown for both sound actuators 104, 105.

In FIG. 4 three pixels 201 of the LCD cell 103 are separately marked because behind these pixels 201 support rods 306-1 to 306-3 (see FIG. 5) contact the LCD cell 103 and couple the LCD cell 103 to the respective sound actuator 104, 105. This means that these three pixels 201 could be less illuminated through the backplane 3 because the path of the light is obstructed by the support rods 306-1 to 306-3.

In practical applications the support rods 306-1 to 306-3 can be provided with a material which is capable of guiding light to the front of the LCD cell 103. The light could e.g. be coupled from a light guide plate 304 (see FIG. 5) into the support rods 306-1 to 306-3 and then to the LCD cell 103. Even if the light provided to the LCD cell 103 by the support rods 306-1 to 306-3 is less than at the remaining pixels of the LCD cell 103, this difference is not or almost not perceptible by a human spectator. The difference in illumination of the single pixels of the LCD cell 103 becomes even less relevant with higher resolution displays. On a 50" screen with full hd resolution there are about 44 pixels per inch or 17.3 pixels per centimetre. On a 50" screen with 4K UHD resolution there are about 88 pixels per inch or 34.6 pixels per centimetre. This means that every single pixel in 4K UHD is only 0.28 mm wide.

Figure 5:
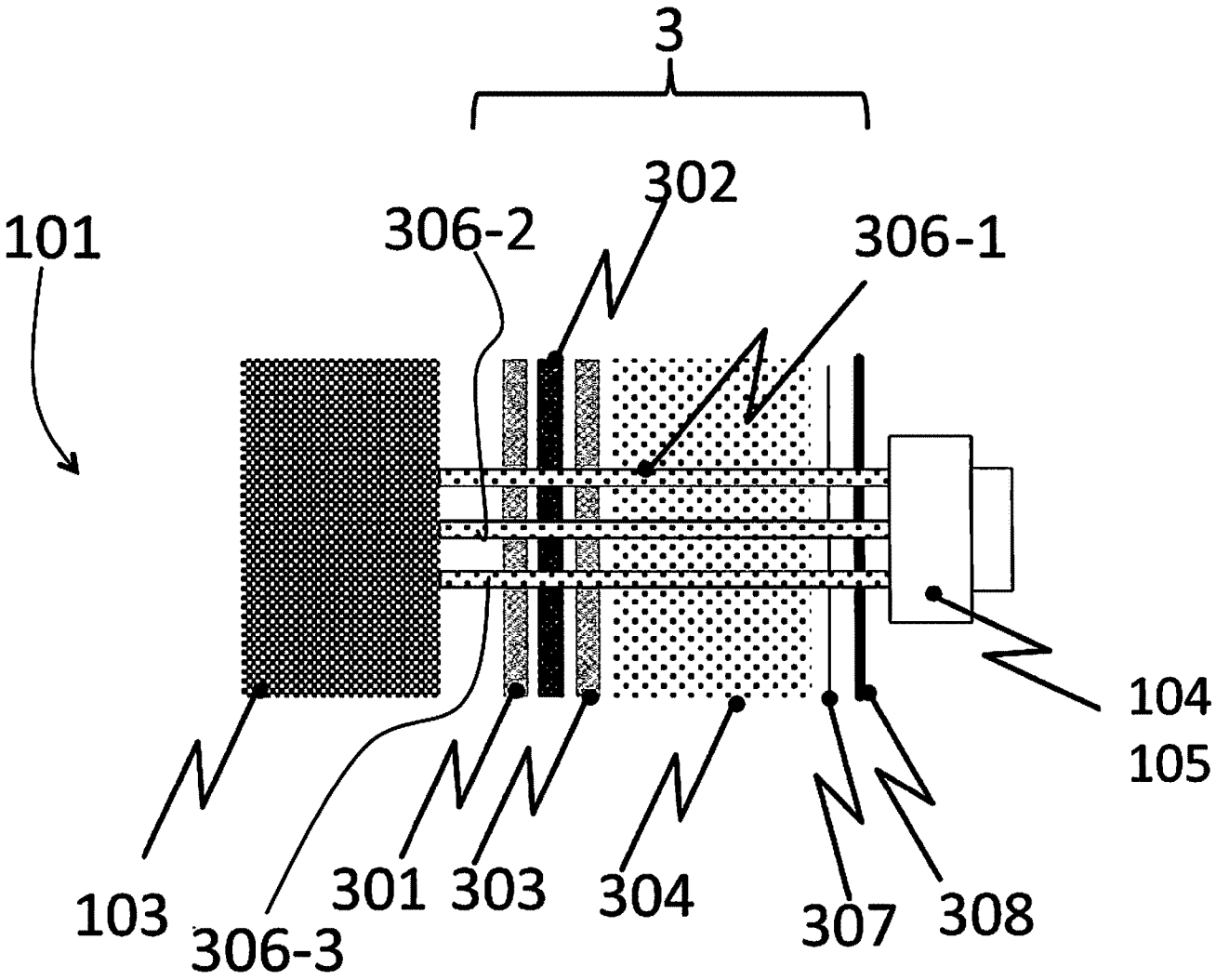
FIG. 5 shows a further diagram of the television according to the present invention.

FIG. 5 shows a detailed side view of the section of the display device 101 with a sound actuator 104, 105. As with FIG. 4 only one sound actuator 104, 105 is shown because both sections are identical.

In FIG. 5 the backplane 3 consists from front to back of a diffuser film 301, a prism sheet 302, a diffuser film 303, a light guide plate 304, a reflector sheet 307 and a metal back cover 308. The diffuser film 301, the prism sheet 302, the diffuser film 303, light guide plate 304, and the reflector sheet 307 together form a backlight for the LCD cell 103. The metal back cover 308 provides mechanical stability to this stack of films and sheets.

Behind the backplane 3 a sound actuator 104, 105 is provided, which is mechanically connected to the LCD cell 103 via support rods 306-1 to 306-3 which traverse the backplane 3. For this purpose holes 8-1, 8-2, 8-3 (see FIG. 8) are provided in the backplane 3. The light guide plate 304 and the support rods 306-1 to 306-3 are all depicted as dotted elements. This serves to illustrate that the light guide plate 304 and the support rods 306-1 to 306-3 both comprise the same or a similar material. Similar in this context refers to the light guiding capabilities of the material. This means that light traveling through the light guide plate 304 can exit the light guide plate 304 and couple into the support rods 306-1 to 306-3, which guide the light to the LCD cell 103.

Figure 6:
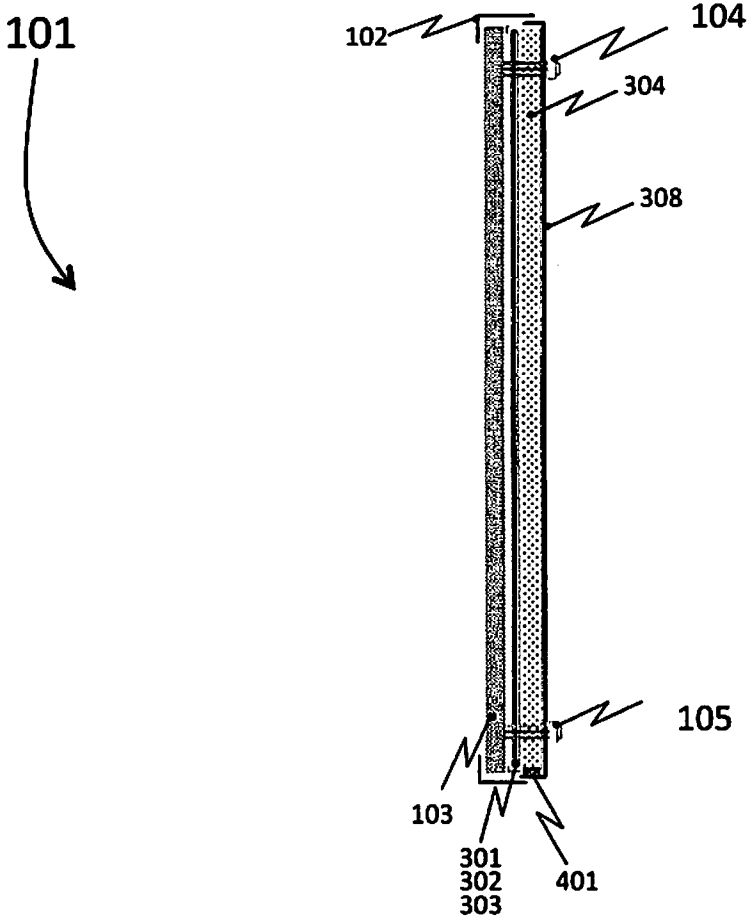
FIG. 6 shows a further diagram of the television according to the present invention.

FIG. 6 shows a cross-sectional side view of the television 101. It can be seen in FIG. 6 that the stack sequence already shown in FIG. 5 is provided for the whole television 101 or the complete surface of the television 101. Corresponding to FIG. 3 the sound actuator 104 is positioned on the upper edge of the LCD cell 103 and the sound actuator 105 is positioned on the lower edge of the LCD cell 103.

In addition a LED 401 is shown on the lower edge of the light guide plate 304. This LED 401 is only exemplarily shown representing a plurality of LEDs which are possible on the circumference of the light guide plate 304. The stack consisting of diffuser film 301, prism sheet 302, diffuser film 303, light guide plate 304, and reflector sheet 307 will distribute the light of the edge LEDs 401 as uniformly as possible over the surface of the LCD cell 103.

Figure 7:
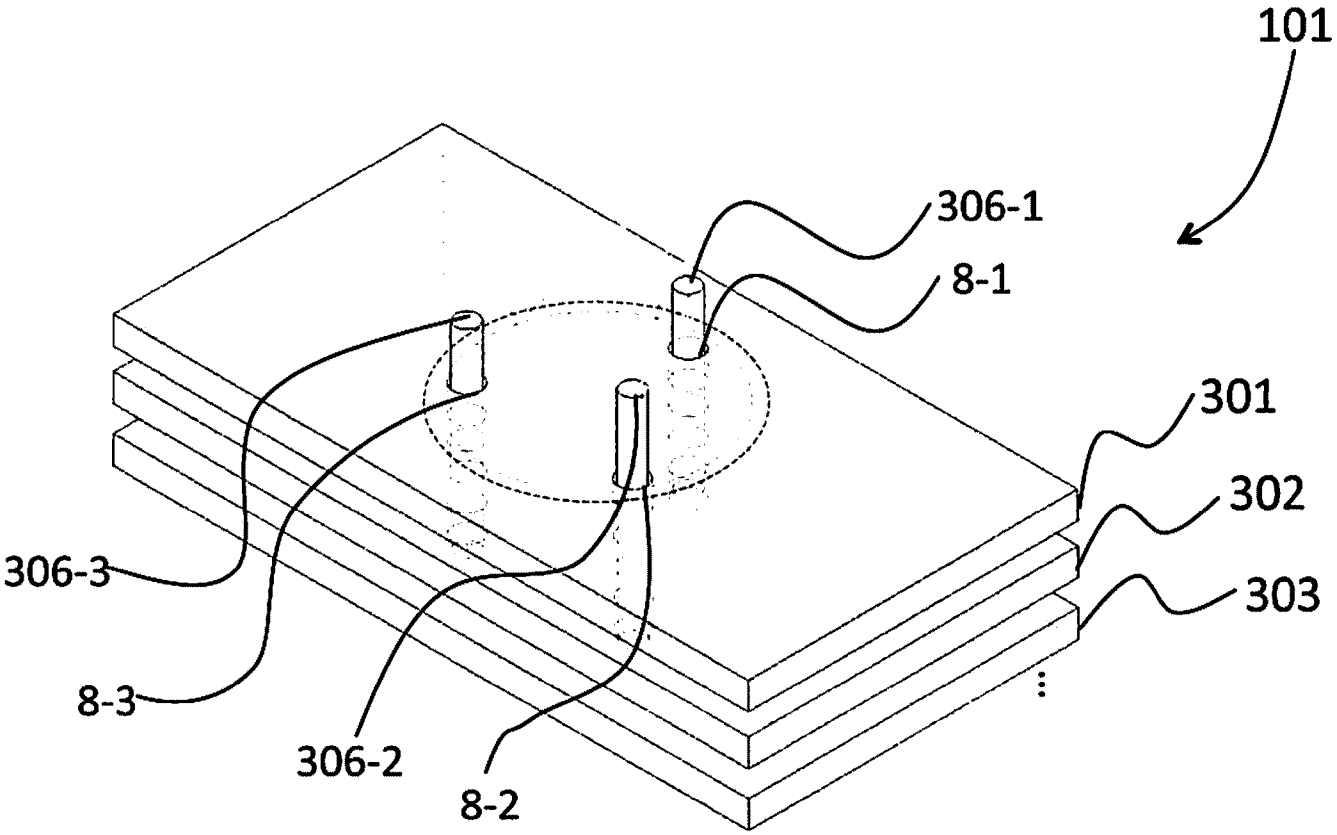
FIG. 7 shows a further diagram of the television according to the present invention.

FIG. 7 shows detailed view of the stack of diffuser film 301, prism sheet 302, and diffuser film 303. The further layers are hinted at by three dots.

Each of the depicted layers comprises holes 8-1, 8-2 and 8-3 where the support rods 306-1 to 306-3 traverse the backplane 3. The holes 8-1, 8-2 and 8-3 are bigger than the support rods 306-1 to 306-3 such that the support rods 306-1 to 306-3 can move freely within the holes 8-1, 8-2 and 8-3.

In FIG. 7 the holes 8-1, 8-2 and 8-3 and the support rods 306-1 to 306-3 are round shaped, i.e. they have a round shaped cross section. It is to be understood that square shaped, elliptical cross sections or any other cross section would also be possible.

Figure 8:
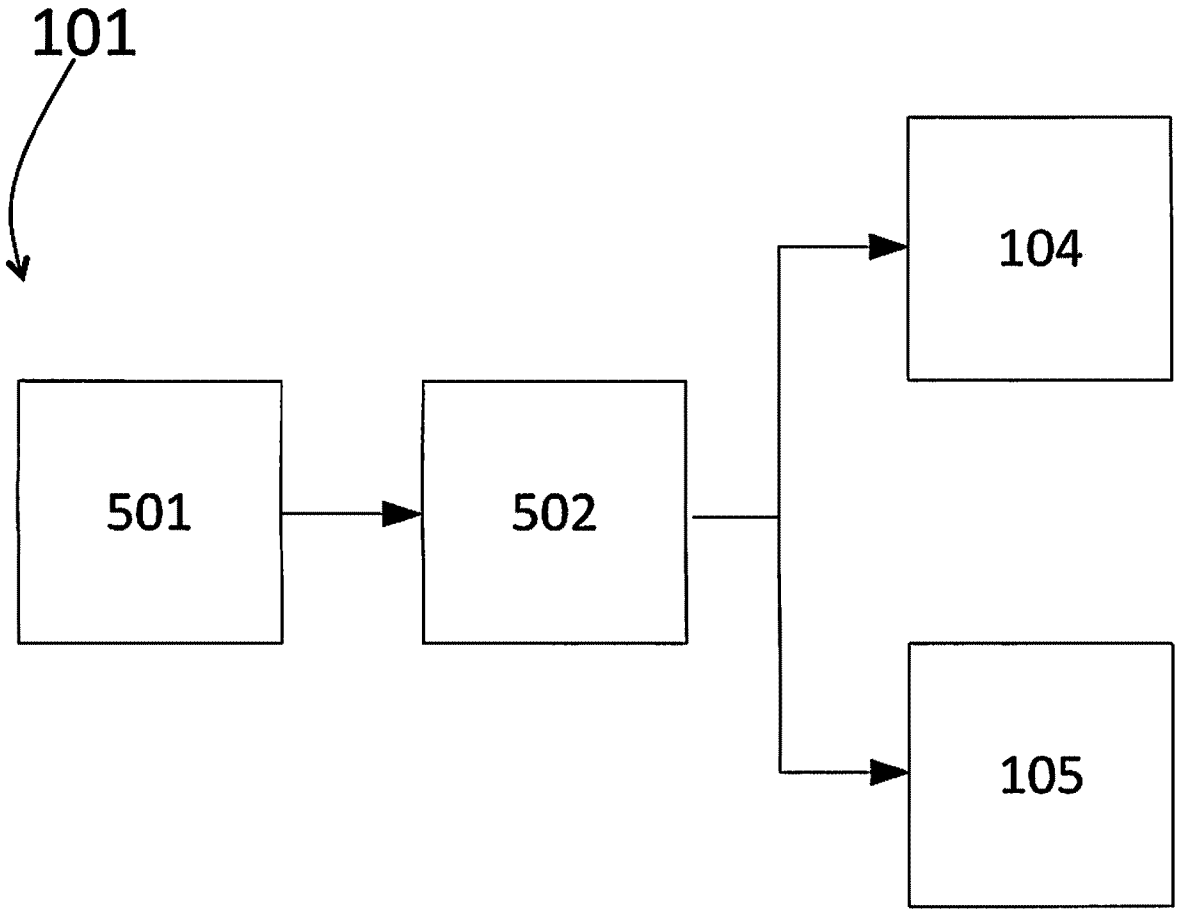
FIG. 8 shows a further diagram of the television according to the present invention.

FIG. 8 shows a block diagram of an embodiment of a display device 101 according to the present invention.

The display device 101 comprises a mainboard 501 which is electronically coupled to an audio amplifier 502 which in turn is electronically coupled to the sound actuators 104, 105 to drive said sound actuators 104, 105 with a corresponding driving signal 5.

The main board 501 can comprise any digital and/or programmable electronic circuitry which is needed to receive or decode video and audio signals and forward the video signals to the LCD cell 103 and the audio signals to the audio amplifier 502.

The audio amplifier 502 can e.g. receive a digital audio data stream and convert said audio data stream into an analogue voltage or current signal which represents the respective audio data and when provided to the sound actuators 104, 105 causes the sound actuators 104, 105 to vibrate accordingly. It is to be understood that the conversion of the audio data stream can also be performed by the main board 501, which can provide an analogue audio signal to the audio amplifier 502.

Although specific embodiments have been illustrated and described herein, it will be appreciated by those of ordinary skill in the art that a variety of alternate and/or equivalent implementations exist. It should be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

For example even though described in conjunction with smartphone displays and LCD televisions, the present invention can be used with any device that comprises a display and needs to reproduce sounds. Furthermore, not only LCD based displays can be used with the present invention. For example Plasma-screens, OLED or AMOLED displays or the like can also be used with the present invention.

Even though described above as stereo audio system, e.g. a television with two sound actuators, the present invention can be used to provide an array of loudspeakers by providing a plurality of loudspeakers in a display device. Such an array of loudspeakers can be used e.g. to perform wave field synthesis.

The present invention as explained above describes a display device comprising an imaging plane configured to controllably display an image, a backplane located behind the imaging plane, a number of sound actuators configured to produce vibrations based on a driving signal, and at least one mechanical coupling element for every sound actuator configured to mechanically couple the imaging plane through the backplane with the sound actuators.

LIST OF REFERENCE SIGNS

1, 101 display device
2, 103 imaging plane
3, backplane
4, 104, 105 sound actuators
5 driving signal
6 coupling element
7-1, 7-2, 401 LEDs
306-1 to 306-3 support rod
8-1 to 8-3 holes
304 light guide plate
102 front bezel
201 pixels
301, 303 diffuser film
302 prism sheet
307 reflector sheet
308 metal back cover
402 middle frame
501 mainboard
502 audio amplifier

The invention claimed is:

1. Display device comprising:

an imaging plane configured to controllably display an image, a backplane located behind the imaging plane, a number of sound actuators configured to produce vibrations based on a driving signal, and at least one mechanical coupling element for every sound actuator configured to mechanically couple the imaging plane through the backplane with the sound actuators;

wherein the mechanical coupling elements each comprise a number of support rods, which on one end couple to the respective sound actuator and on the other end couple to the imaging plane;

wherein the backplane comprises holes for the support rods which have an inner contour which is spaced apart by a predetermined distance from the outer contour of the support rods, wherein the cross section of the support rods is smaller than or equal to three pixels, especially smaller than or equal to two pixels or smaller than or equal to one pixel of the imaging plane.

2. Display device according to claim 1, wherein the backplane comprises a light guide plate and wherein the support rods comprise a material configured to at least partially guide light.

3. Display device according to claim 2, comprising light coupling elements in the light guide plate, especially at the edges of the holes, the light coupling elements being configured to couple light from the light guide plate into the support rods.

4. Display device according to claim 1, comprising two sound actuators being placed in a front view of the display device on opposite sides and different heights of the display device behind the imaging plane of the display device.

5. Method for reproducing sound with a display device, comprising the steps of:

producing vibrations based on a driving signal with a number of sound actuators in a display device, transferring the vibrations mechanically with at least one mechanical coupling element for every sound actuator to an imaging plane of the display device through a backplane of the display device;

wherein transferring the vibrations mechanically comprises transferring the vibrations with support rods, which on one end couple to the respective sound actuator and on the other end couple to the imaging plane, through holes in the backplane which have an inner contour which is spaced apart by a predetermined distance from the outer contour of the support rods, wherein transferring the vibrations mechanically comprises transferring the vibrations with support rods which have a cross section smaller than three pixels, especially less than two pixels or less than one pixel of the imaging plane.

6. Method according to claim 5, further comprising guiding light in the backplane with a light guide plate and at least partially guiding light from the light guide plate through the support rods.

7. Method according to claim 6, comprising coupling light with light coupling elements in the light guide plate into the support rods.

8. Method according to claim 5, comprising transferring the vibrations mechanically with two sound actuators being placed in a front view of the display device on opposite sides and different heights of the display device behind the imaging plane of the display device, or with a plurality of sound actuators, which are configured to collectively perform a wave field synthesis.

9. Display device comprising:

an imaging plane configured to controllably display an image, a backplane located behind the imaging plane, a number of sound actuators configured to produce vibrations based on a driving signal, and at least one mechanical coupling element for every sound actuator configured to mechanically couple the imaging plane through the backplane with the sound actuators;

wherein the mechanical coupling elements each comprise a number of support rods, which on one end couple to the respective sound actuator and on the other end couple to the imaging plane;

wherein the backplane comprises holes for the support rods which have an inner contour which is spaced apart by a predetermined distance from the outer contour of the support rods, wherein the backplane comprises a light guide plate and wherein the support rods comprise a material configured to at least partially guide light.

10. Method for reproducing sound with a display device, comprising the steps of:

producing vibrations based on a driving signal with a number of sound actuators in a display device, transferring the vibrations mechanically with at least one mechanical coupling element for every sound actuator to an imaging plane of the display device through a backplane of the display device; and guiding light in the backplane with a light guide plate and at least partially guiding light from the light guide plate through the support rods, wherein transferring the vibrations mechanically comprises transferring the vibrations with support rods, which on one end couple to the respective sound actuator and on the other end couple to the imaging plane, through holes in the backplane which have an inner contour which is spaced apart by a predetermined distance from the outer contour of the support rods.

* * * * *